US007822375B2

(12) United States Patent
Osawa

(10) Patent No.: US 7,822,375 B2
(45) Date of Patent: Oct. 26, 2010

(54) IMAGE FORMING APPARATUS THAT MAY CORRECT THE POSITIONAL ALIGNMENT OF IMAGES

(75) Inventor: Fujio Osawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 855 days.

(21) Appl. No.: 11/783,675

(22) Filed: Apr. 11, 2007

(65) Prior Publication Data

US 2008/0056777 A1 Mar. 6, 2008

(30) Foreign Application Priority Data

Sep. 6, 2006 (JP) ..... 2006-241540

(51) Int. Cl.
*G03G 15/01* (2006.01)

(52) U.S. Cl. ..... 399/301

(58) Field of Classification Search ..... 399/49, 399/301; 347/116

See application file for complete search history.

(56) References Cited

U.S. PATENT DOCUMENTS

| | | | | |
|---|---|---|---|---|
| 7,471,908 | B2 * | 12/2008 | Soya et al. | 399/49 |
| 7,664,413 | B2 * | 2/2010 | Kobayashi et al. | 399/301 |
| 2005/0207768 | A1 | 9/2005 | Suzuki | 399/49 |
| 2005/0207786 | A1 | 9/2005 | Askren et al. | 399/49 |
| 2007/0189789 | A1 | 8/2007 | Suzuki | 399/49 |

FOREIGN PATENT DOCUMENTS

| | | |
|---|---|---|
| JP | 2000-305336 | 11/2000 |
| JP | 2003-005490 | 1/2003 |
| JP | 2006-126655 | 5/2006 |

* cited by examiner

*Primary Examiner*—William J Royer
(74) *Attorney, Agent, or Firm*—Morgan, Lewis & Bockius LLP

(57) ABSTRACT

An image forming apparatus includes: plural image holding members, on respective surfaces of which toner images are formed, the toner images being arrayable such that the length in the array direction and the color are different between adjacent toner images; a transfer body, onto which the toner images formed on the plural image holding members are transferred, such that there is a spacing between the adjacent toner images in the array direction; a detecting unit, detecting the length in the array direction of each of the toner images transferred onto the transfer body and detecting the amount of shift in the array direction of each toner image from a reference position; and a correction unit, correcting misalignment of each toner image of each color using the shift amount of the toner image with a length detected by the detecting unit within a predetermined threshold range.

12 Claims, 12 Drawing Sheets

FIG.3A

| COLOR | K | Y | M | C |
|---|---|---|---|---|
| LENGTH | tk | ty | tm | tc |
| LENGTH PREDETERMINED COEFFICIENT | $\alpha k$ | $\alpha y$ | $\alpha m$ | $\alpha c$ |

FIG.3B

| COLOR | K | Y | M | C |
|---|---|---|---|---|
| DENSITY | dk | dy | dm | dc |
| DENSITY PREDETERMINED COEFFICIEN | $\beta k$ | $\beta y$ | $\beta m$ | $\beta c$ |

IMAGE FORMING APPARATUS THAT MAY CORRECT THE POSITIONAL ALIGNMENT OF IMAGES

CROSS-REFERENCE TO RELATED APPLICATION

This application claims priority under 35 USC 112 from Japanese Patent Application No. 2006-241540 filed Sep. 6, 2006.

BACKGROUND

1. Technical Field

The present invention relates to an image forming apparatus, and more particularly to an image forming apparatus that may correct the positional alignment of images.

2. Related Art

In an image forming apparatus that has plural image forming units forming toner images of each of the colors, and that transfers and superimposes the toner images formed by the image forming units onto a printing medium such as printer paper or the like, then fixes to the toner images to form a color image, it is known that, when superimposing the toner images of each of the colors, misalignment of the images of each of the colors that is generated by assembly errors, read timing and the like, is a cause of color shift in full color images.

SUMMARY

According to an aspect of the invention, an image forming apparatus includes: plural image holding members, on respective surfaces of which toner images are formed, the toner images being arrayable such that the length in the array direction and the color are different between adjacent toner images from each other; a transfer body, onto which the toner images formed on the plural image holding members are transferred, such that there is a spacing between the adjacent toner images in the array direction and the length and the color of the adjacent toner images are different from each other; a detecting unit, detecting the length in the array direction of each of the toner images transferred onto the transfer body and detecting the amount of shift in the array direction of each toner image from a reference position; and a correction unit, correcting misalignment of each toner image of each color using the shift amount of the toner image with a length detected by the detecting unit within a predetermined threshold range.

Exemplary embodiments of the present invention will be described in detail based on the following figures, in which:

FIG. 3A is a table relating to lengths of toner images of each color, showing predetermined coefficients for deriving design values and thresholds relating to toner images of each color, in order to carry out correction of toner image alignment in an image forming apparatus according to an exemplary embodiment of the present invention;

FIG. 3B is a table relating to densities of toner images of each color, showing predetermined coefficients for deriving design values and thresholds relating to toner images of each color in order to carry out correction of toner image alignment in an image forming apparatus according to an exemplary embodiment of the present invention;

Figure 6A:
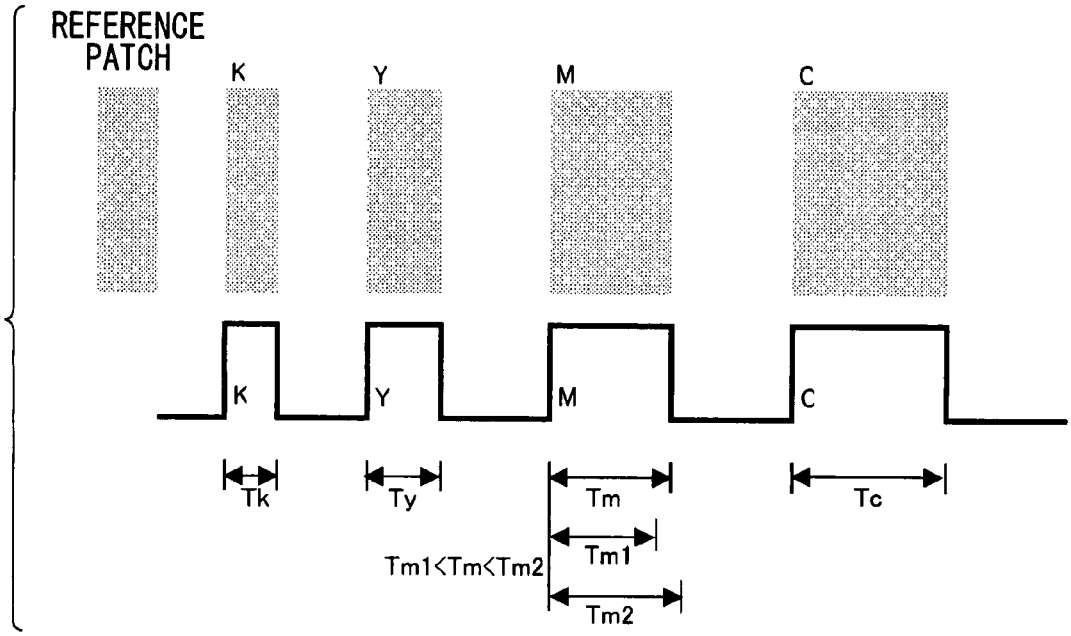
Figure 6B:
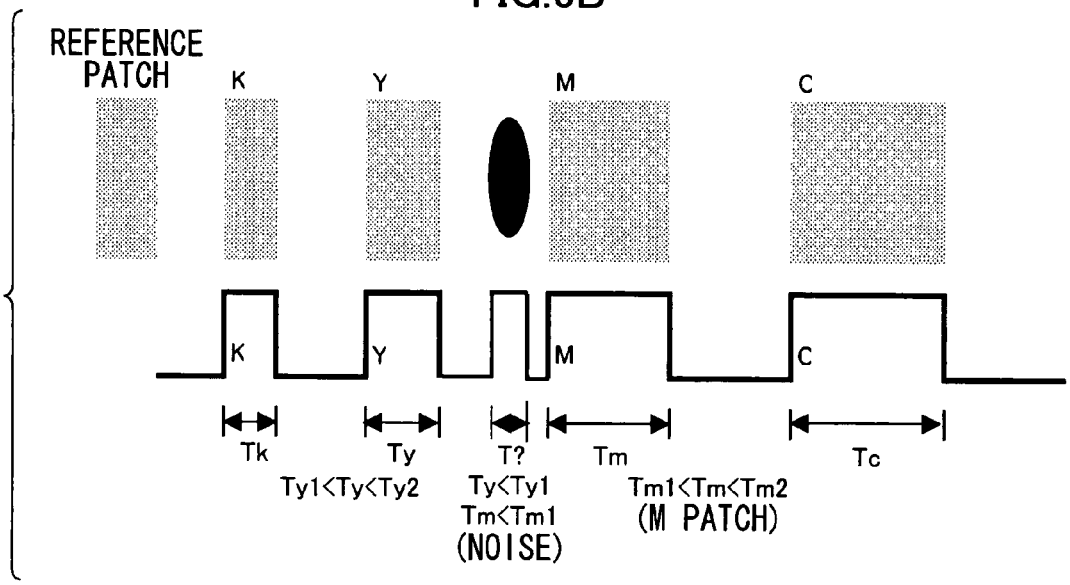
Figure 7:
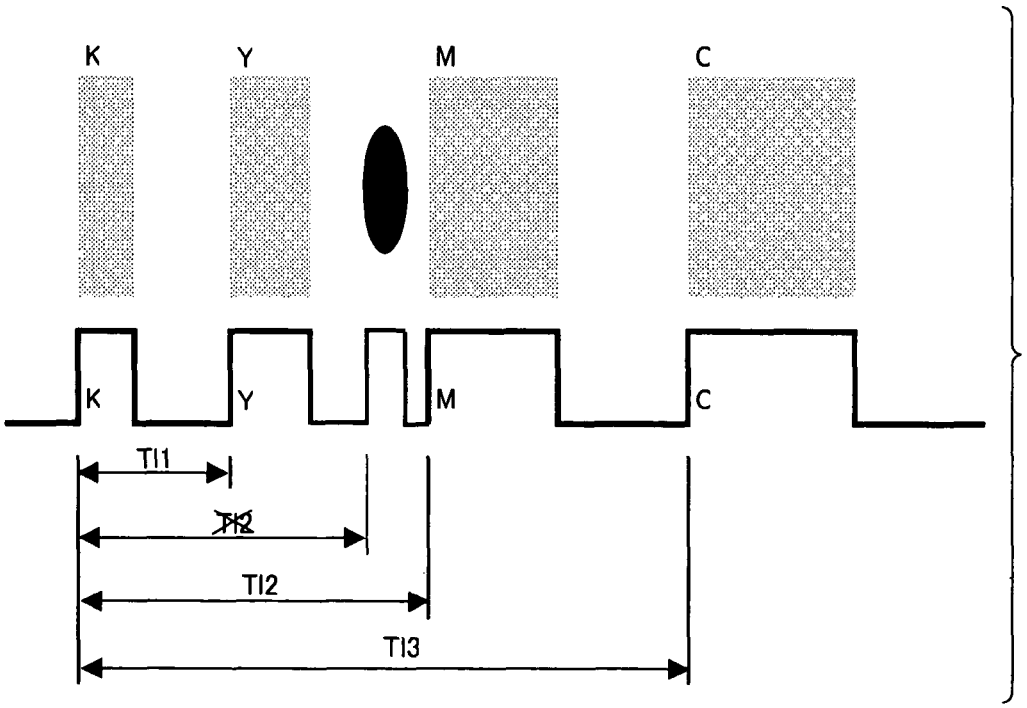
Figure 8:
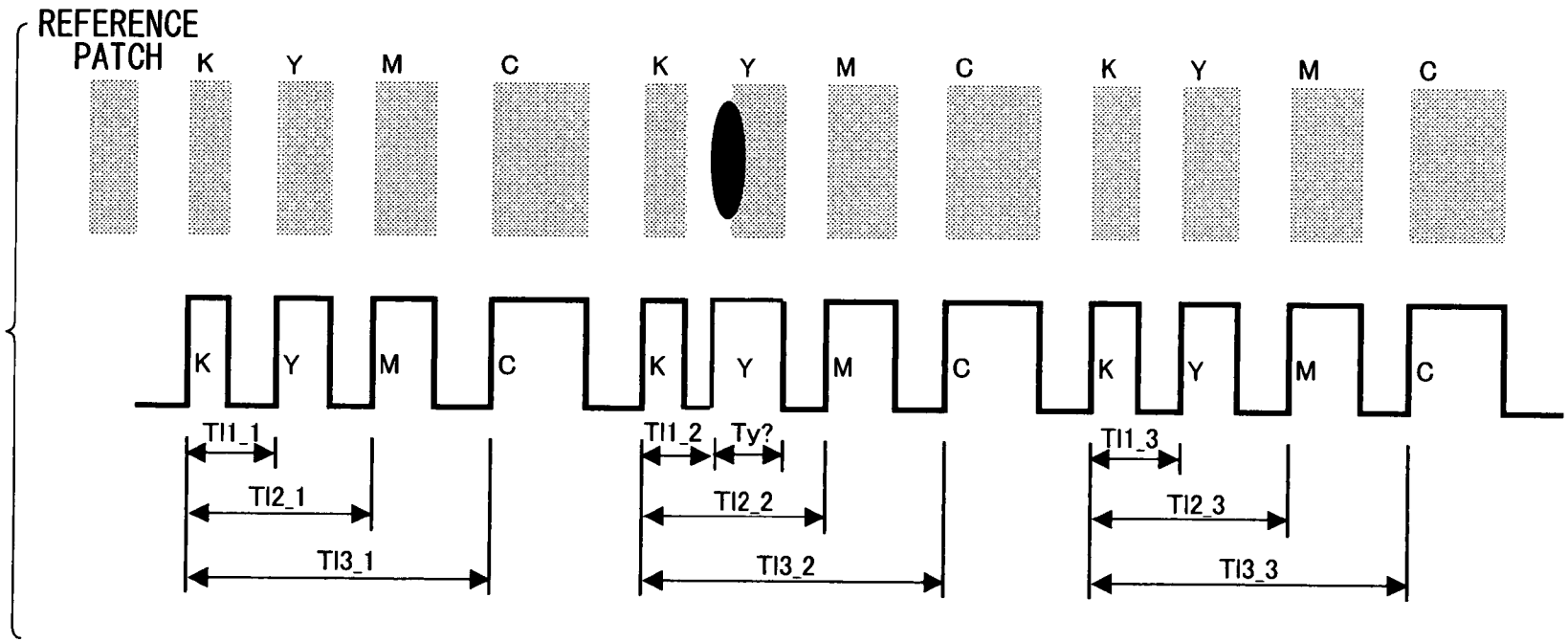
Figure 9:
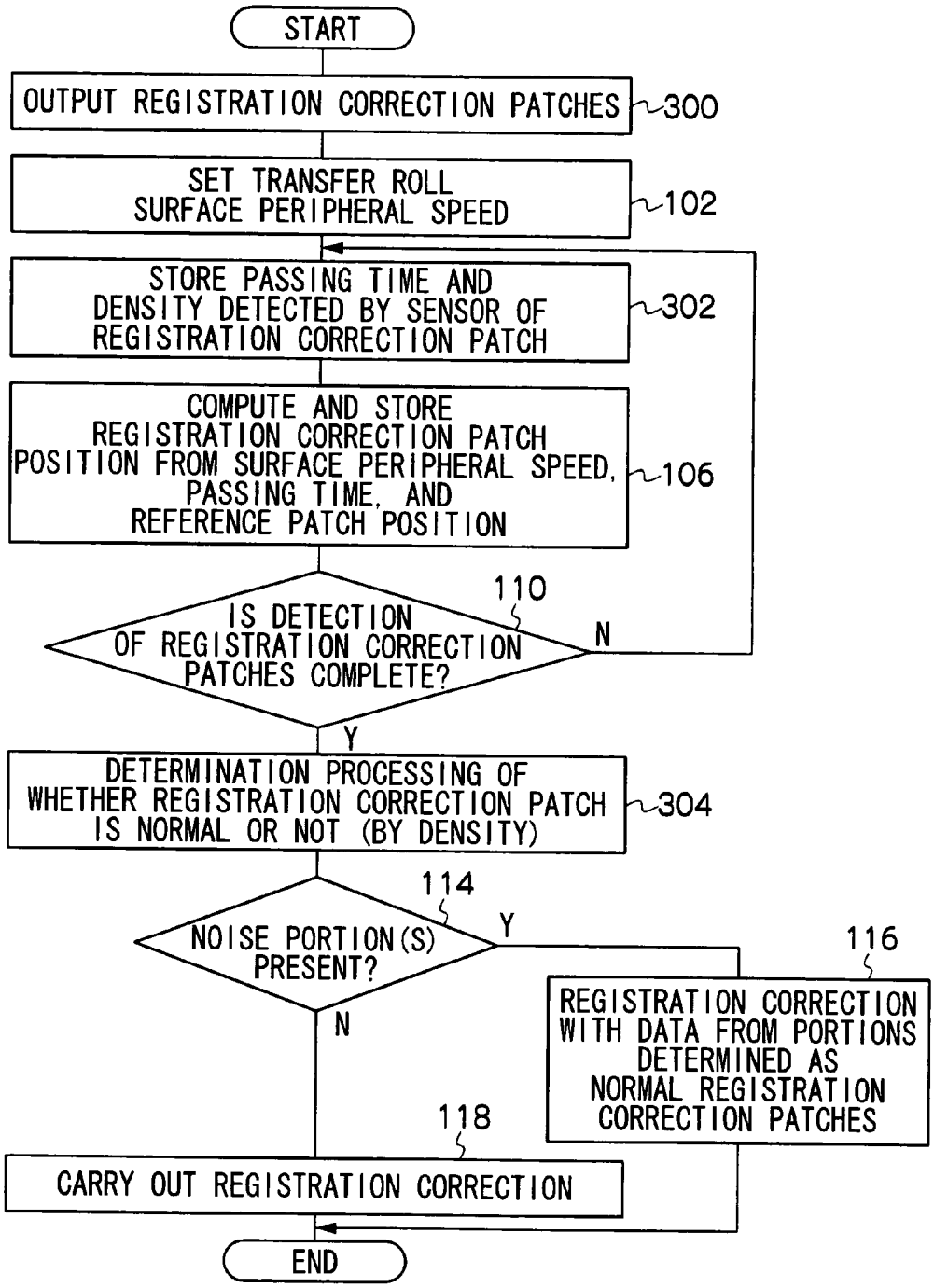
Figure 10:
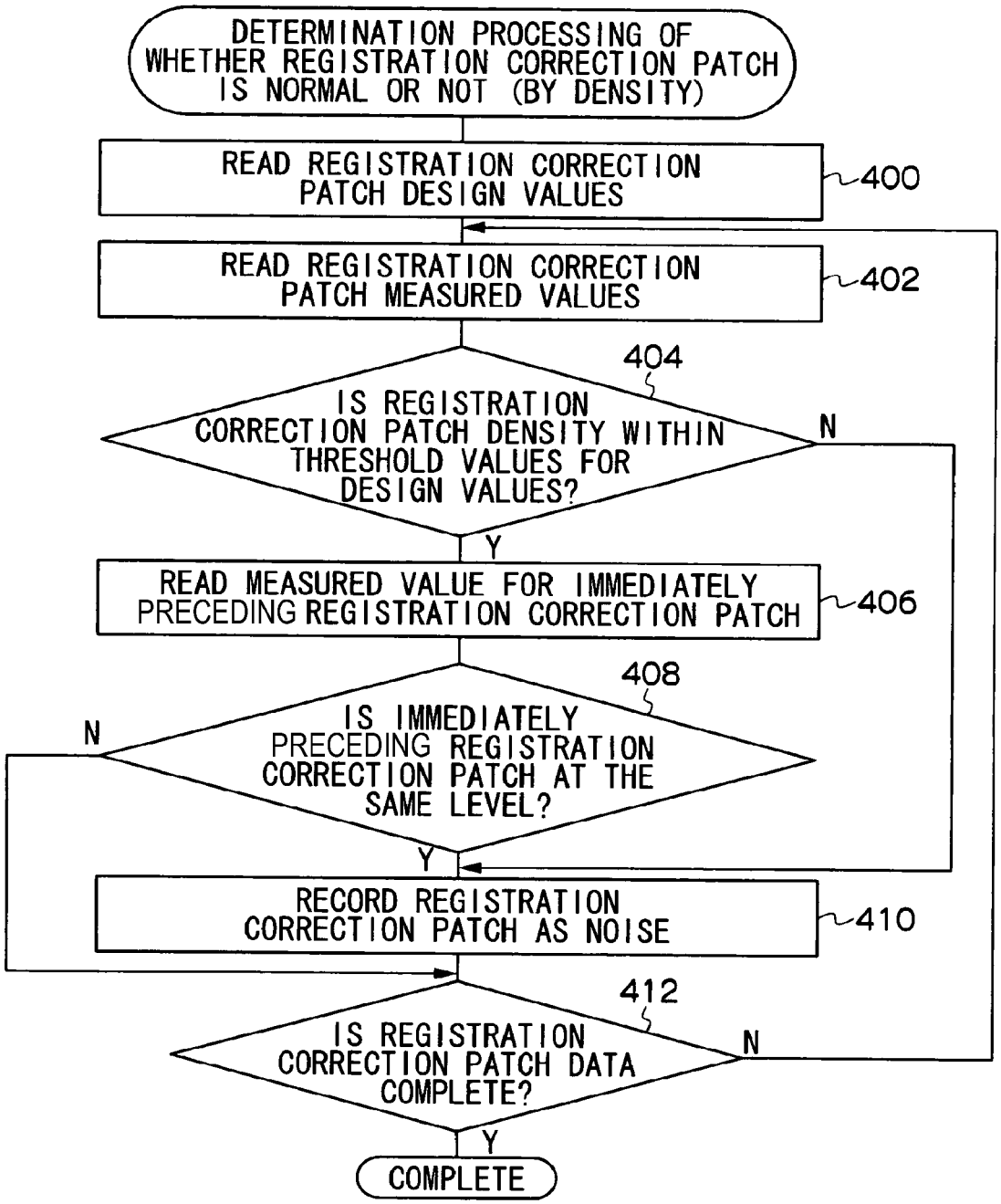
Figure 11A:
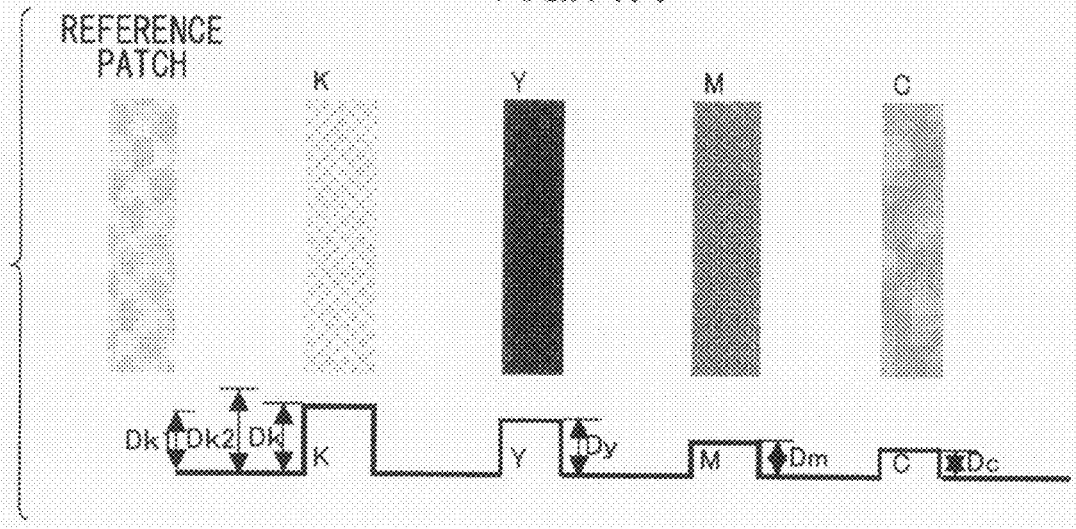
Figure 11B:
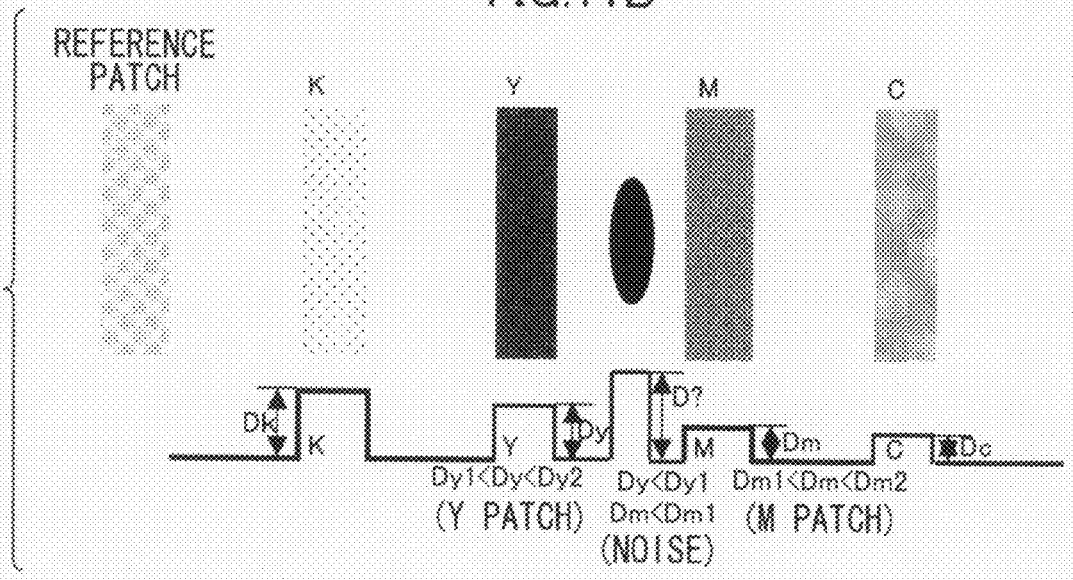
Figure 12:
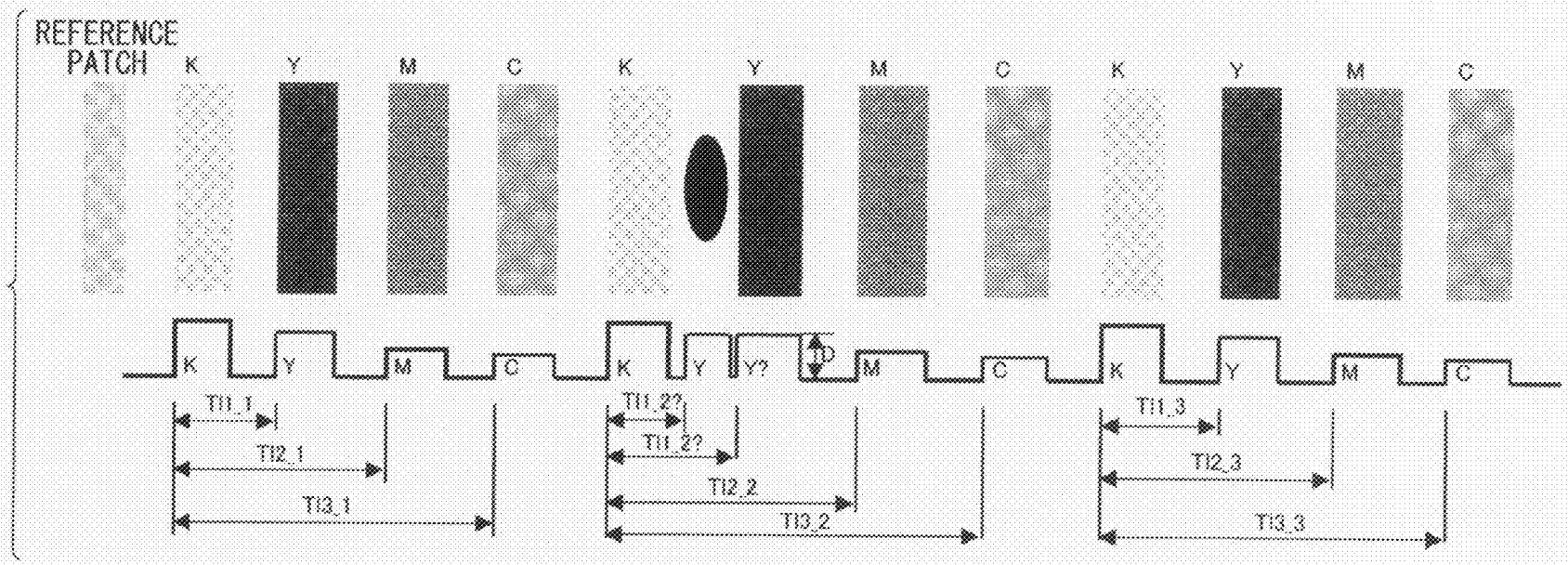

FIG. 6A is a diagram showing an arrangement of registration correction patches that are made different in color and in length, for determining for each of the colors whether measured values relating to the length of the registration correction patch is within a threshold value range or not, in a case when for each of the colors the lengths of the registration correction patches is within a threshold value range, in the first exemplary embodiment of the present invention;

FIG. 6B is a diagram showing an arrangement of registration correction patches that are made different in color and in length, for determining for each of the colors whether measured values relating to the length of the registration correction patch is within a threshold value range or not, in a case when a length of the registration correction patches for each of the colors that is outside of a threshold value range is determined to be noise in the first exemplary embodiment of the present invention;

FIG. 7 is a diagram for explaining, when carrying out registration correction, carrying out of registration correction excluding a range that has been determined as noise in the first exemplary embodiment of the present invention;

FIG. 8 is a diagram for explaining carrying out registration correction for an array of plural registration correction patches that are made different in color and in length, wherein, excluding a range determined to be noise, registration correction is carried out for each of the colors using an average value of registration correction patch shift amount, in the first exemplary embodiment of the present invention;

FIG. 9 is a flow chart showing processing for carrying out registration correction based on density of registration correction patches for each color in an image forming apparatus according to a second exemplary embodiment of the present invention;

FIG. 10 is a flow chart showing processing for determining whether a registration correction patch is a normal registration correction patch or is noise, when carrying out registration correction based on density of registration correction patches for each color in an image forming apparatus according to the second exemplary embodiment of the present invention;

FIG. 11A is a diagram for explaining an array of registration correction patches that are made different in color and in density, for determining for each of the colors whether a measured value relating to the density of the registration correction patch is within a threshold value range or not, showing a case when for each of the colors the density of the registration correction patches is within a threshold value range, in the second exemplary embodiment of the present invention;

FIG. 11B is a diagram showing an array of registration correction patches that are made different in color and in density, for determining for each of the colors whether a measured value relating to the density of the registration correction patch is within a threshold value range or not, showing a case when a density of the registration correction patches for each of the colors that is outside of a threshold value range is determined to be noise in the second exemplary embodiment of the present invention;

FIG. 12 is a diagram for explaining carrying out registration correction for an array of plural registration correction patches that are made different in color and in density, wherein, excluding a range determined to be noise, registration correction is carried out for each of the colors using an average value of registration correction patch shift amount, in the first exemplary embodiment of the present invention;

DETAILED DESCRIPTION

Exemplary embodiments of the present invention will now be explained with reference to the drawings.

First Exemplary Embodiment

Figure 1:
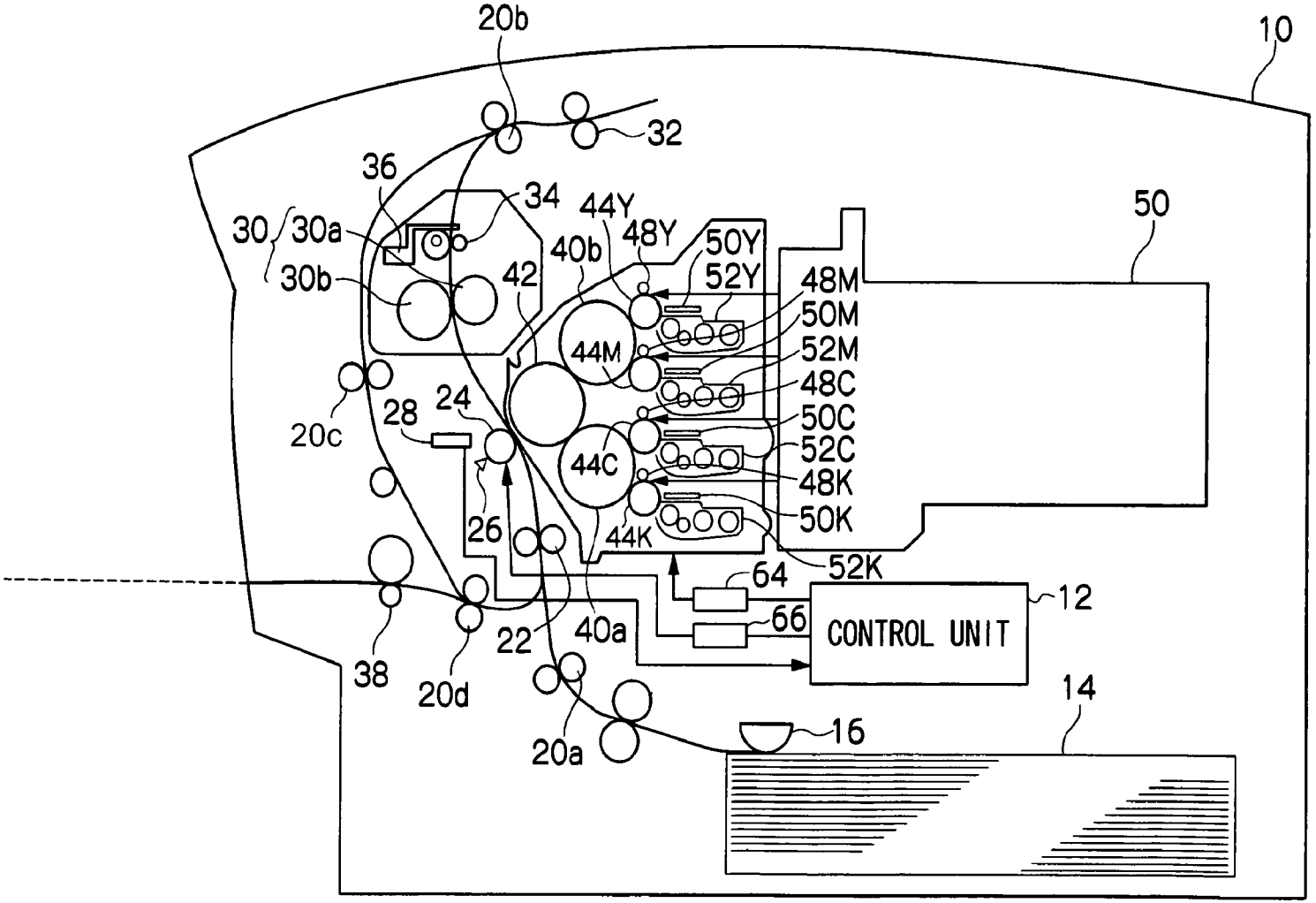
FIG. 1 is an outline diagram of an image forming apparatus according to an exemplary embodiment of the present invention, in which correction of toner image alignment and printing may be carried out.

FIG. 1 is an outline block diagram of an image forming apparatus of the first exemplary embodiment of the present invention. As shown in the diagram, an image forming apparatus 10 is provided with: a paper supply cassette 14, for supplying paper as a recording medium; a half-moon roll 16, for conveying paper one sheet at a time from the paper supply cassette 14; pairs of paper conveying rolls 20*a*, 20*b*, 20*c*, 20*d*, for conveying out the paper; a pair of paper delay rolls 22, for delaying the paper; a transfer roll 24, for transferring onto the paper a toner image formed by a secondary intermediate transfer drum 42, described below, and on which is formed, when there is not paper present, a toner image that is for correcting toner image alignment on the surface of the paper, in other words on which a registration correction patch is formed; an optical sensor 28, detecting an amount of reflected light from the registration correction patch formed on the transfer roll 24 and from the surface of the transfer roll 24; a cleaner 26, cleaning the surface of the transfer roll 24; a fixing unit 30, including a pressing roll 30*b* pressing a toner image formed on the paper, and a heating roll 30*a* heating a toner image; a pair of fixing unit exit rolls 34, for conveying the paper; a fixing unit exit switch 36, for detecting the trailing edge of the paper; a pair of exit rolls 32, for discharging the paper; and a pair of hand feed paper supply rolls 38, for supplying the paper from outside of the image forming apparatus 10.

The image forming apparatus 10 is also provided with photoreceptor drums 44Y, 44M, 44C and 44K that are plural image holding members corresponding to each of the colors yellow (Y), magenta (M), cyan (C), and black (K), and the photoreceptor drums 44Y, 44M, 44C and 44K are rotated in a clock-wise direction by a drive device, not shown.

The image forming apparatus 10 is also provided with: charging units 48Y, 48M, 48C and 48K, uniformly charging the respective photoreceptor drums 44Y, 44M, 44C and 44K; and an exposing unit 50, configured of semi-conductor lasers emitting a spot beam according to image signals of the respective colors for forming electrostatic latent images of each color on the respective photoreceptor drums 44Y, 44M, 44C and 44K; and developing units 52Y, 52M, 52C and 52K for respective colors, developing the electrostatic latent images formed on respective photoreceptor drums 44Y, 44M, 44C and 44K using respective colored toners.

The image forming apparatus 10 is also provided with: a primary intermediate transfer drum 40*a*, onto which the K and C color toner images formed on the respective photoreceptor drums 44K and 44C are superimposed and transferred; a primary intermediate transfer drum 40*b*, onto which the M and Y color toner images formed on the respective photoreceptor drums 44M and 44Y are superimposed and transferred; and the secondary intermediate transfer drum 42, onto which the toner images formed on the primary intermediate transfer drums 40*a*, 40*b* are superimposed and transferred.

Figure 2:
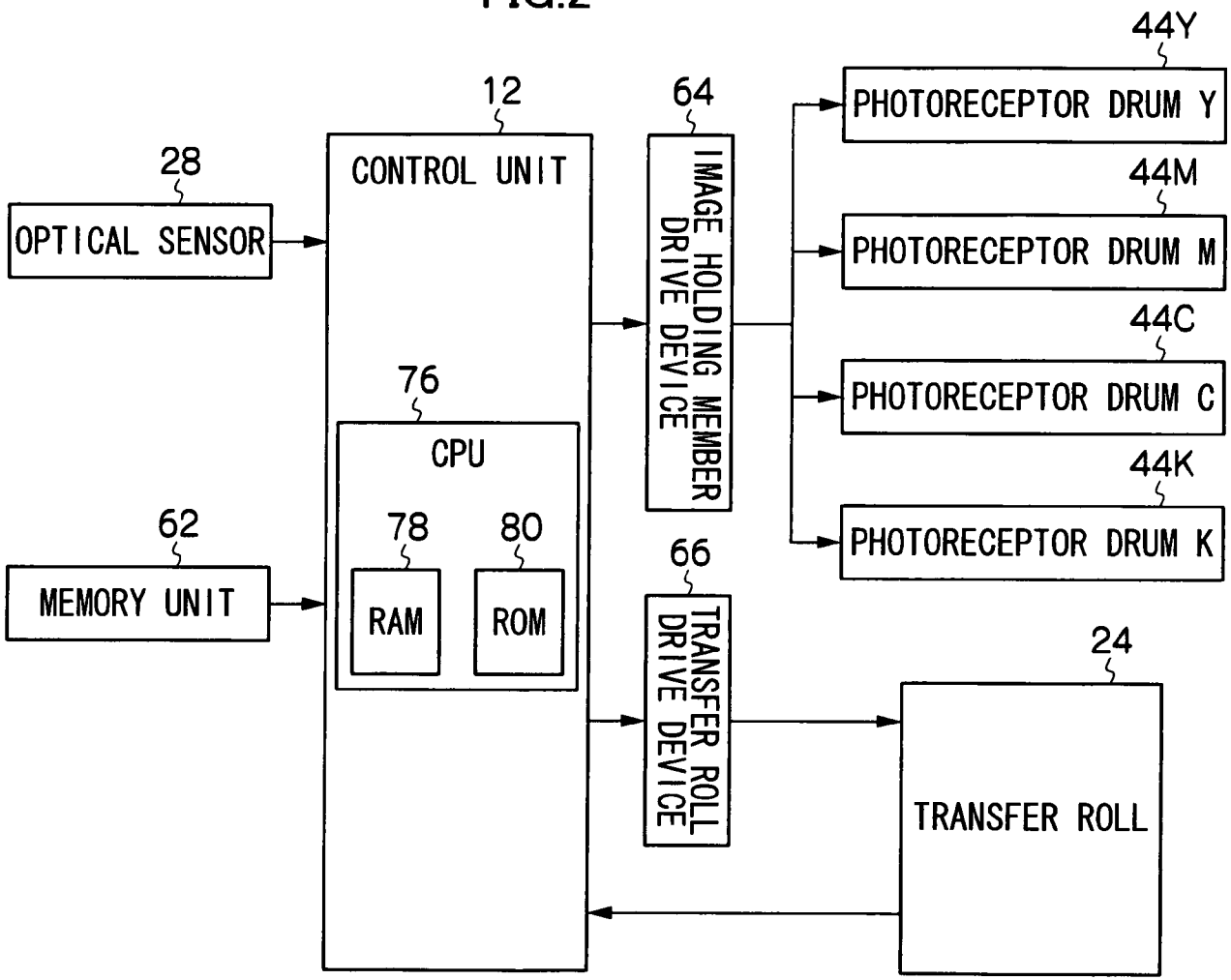
FIG. 2 is a block diagram showing an apparatus controlled by a control unit of an image forming apparatus according to an exemplary embodiment of the present invention.

Furthermore, in the image forming apparatus 10, as shown in FIG. 2, is a provided a control unit 12, loaded with a CPU 76 equipped with a temporary memory medium RAM 78 and a memory medium ROM 80. On the ROM 80 is stored a processing routine program or the like for executing print processing. The control unit 12 is connected to: the optical sensor 28; a memory unit 62, for storing data that is necessary for carrying out print processing and the like; an image holding member drive device 64, for driving the image holding bodies of the photoreceptor drum 44Y, the photoreceptor drum 44M, the photoreceptor drum 44C and the photoreceptor drum 44K; a transfer roll drive device 66, for driving the transfer roll 24; and the like.

Also, when forming registration correction patches, laser beams 50Y, 50M, 50C and 50K, based on registration correction patch image data output from the control unit 12, are emitted from the exposing unit 50, forming electrostatic latent images of registration correction patches for each of the respective colors on the photoreceptor drums 44Y, 44M, 44C and 44K. These electrostatic latent images are developed by the developing units 52Y, 52M, 52C, and 52K.

FIG. 3A shows, for each of the colors K, Y, M, and C, design values of lengths of registration correction patches and predetermined coefficients for the design values, and these design values and predetermined coefficients are stored in advance in the memory unit 62, and these design values and predetermined coefficients are read from the memory unit 62.

Figure 4:
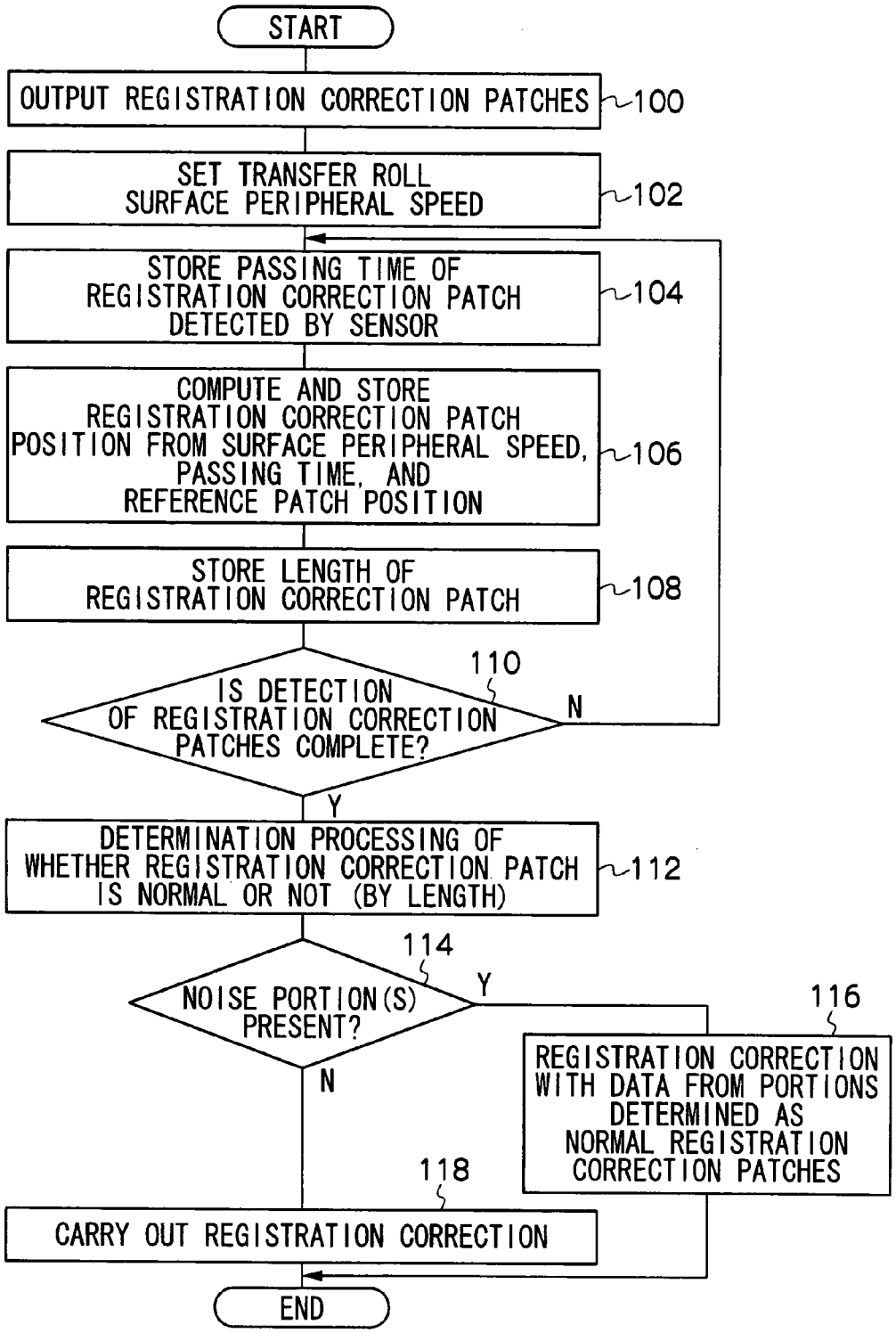
FIG. 4 is a flow chart showing processing for carrying out registration correction based on lengths of registration correction patches of each color in an image forming apparatus according to a first exemplary embodiment of the present invention.

In FIG. 4 is a flow chart showing processing for carrying out registration correction using registration correction patches, with different lengths in the array direction and different colors, for correcting registration correction patch alignment used in an image forming apparatus according to the present exemplary embodiment. In Step 100, each of the respective colors of toner image are formed on the photoreceptor drum 44Y, the photoreceptor drum 44M, the photoreceptor drum 44C and the photoreceptor drum 44K. The K color and C color toner images are transferred onto the primary intermediate transfer drum 40*a*, the M color and Y color toner images transferred onto the primary intermediate transfer drum 40*b*, each of the respective K, C, M, and Y color toner images formed on the primary intermediate transfer drums 40*a* and 40*b* are transferred to the secondary intermediate transfer drum 42, each of the respective toner images transferred onto the secondary intermediate transfer drum 42 are formed as registration correction patches at intervals in the surface circumferential direction of the transfer roll 24. The registration correction patches are formed so that adjacent registration correction patches are different from each other in length in the array direction and different from each other in color.

In the next Step 102, as will be described later, for computing the position of the registration correction patches on the transfer roll 24, the surface peripheral speed of the transfer roll 24 is read from the ROM 80 (for example, 80 mm/sec) and stored in RAM 78; in the next Step 104, times of passing of the leading edges and the trailing edges of the patches for each of the colors formed on the transfer roll 24 past the irradiation position of the optical sensor 28 are measured, based on the change in the amount of reflected light detected by the optical sensor 28, and these times are stored in the RAM 78. By doing so, the detected times of the leading edges and trailing edges of the patches are stored in the RAM 78. In the next Step 106, for the registration correction patches for each of the colors, the positions from a reference position of the leading edges are computed and positions from a reference position of the trailing edges are computed, based on the surface peripheral velocity of the transfer roll 24, the times of passing of the leading edges and trailing edges of the registration correction patches past the irradiation position, and a reference position of a reference patch, and the computed leading edge positions and trailing edge positions are stored in the RAM 78. The reference patch is formed at a position at the front of the other registration correction patches, and, using the leading edge or the trailing edge of the reference patch as the reference position, the leading edge positions and trailing edge positions of the registration correction patches from the reference position are computed and stored in the RAM 78.

The leading edge position of the first registration correction patch from the reference position is derived from the time taken till detection of the leading edge of the registration correction patch from detection of the reference position, multiplied by the surface peripheral velocity of the transfer roll 24. The trailing edge position of the first registration correction patch is derived from the time taken till detection of the trailing edge of the registration correction patch from detection of the leading edge of the registration correction patch, multiplied by the surface peripheral velocity of the transfer roll 24. Regarding the second and subsequent registration correction patches, the leading edge position of the following registration correction patch is derived from the time taken till detection of the leading edge of the following registration correction patch from detection of the trailing edge of the previous registration correction patch, multiplied by the surface peripheral velocity of the transfer roll 24, and added to the distance of the position of the trailing edge of the first registration correction patch from the reference patch. The trailing edge position of the following registration correction patch is derived from the time taken till detection of the trailing edge of the following registration correction patch from detection of the leading edge thereof, multiplied by the surface peripheral velocity of the transfer roll 24. The leading edge positions and trailing edge positions of each of the subsequent registration correction patches are derived in the same manner.

In the next Step 108, the length of the registration correction patches for each of the colors is computed by subtracting the trailing edge position from the leading edge position for each the registration correction patches for each of the colors, and the computed lengths are stored in the RAM 78. In the next Step 110, using the time points of the registration correction patches formed on the transfer roll 24 as a reference, by determining whether the transfer roll 24 has rotated once or not, determination is made as to whether detection of all of the registration correction patches formed has been completed or not.

Figure 5:
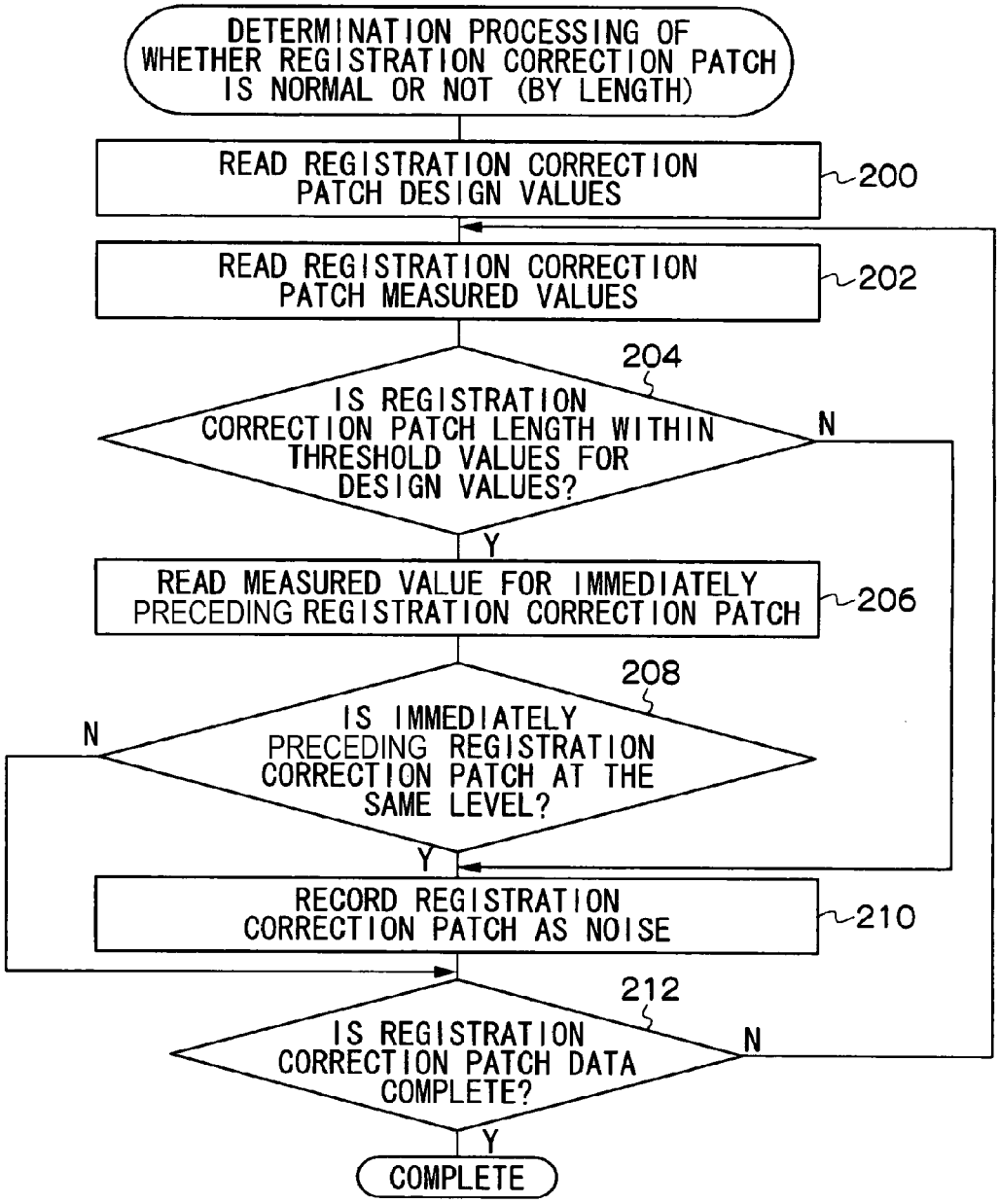
FIG. 5 is a flow chart showing processing for determining whether a registration correction patch is a normal registration correction patch or is noise, when carrying out registration correction based on lengths of registration correction patches for each color in an image forming apparatus according to the first exemplary embodiment of the present invention.

When detection of all of the registration correction patches has been completed the routine proceeds to Step 112, and determination is made for the registration correction patches for each of the colors as to whether they are registration correction patches or not. FIG. 5 is a flowchart showing a routine for determination of the registration correction patches as to whether they are registration correction patches or not.

First, in Step 200, the design values and the predetermined coefficients of the registration correction patches are read. After these values have been read, in Step 202, the measured lengths of the registration correction patches of each of the colors stored in the RAM 78 at Step 108 in FIG. 4 are read.

In the next Step 204, it is determined as to whether a patch is a normal patch or not, by carrying out determination as to whether the measured values of the lengths of the registration correction patches are within the range or not of thresholds, described later, derived from the registration correction patch design values and predetermined coefficients. In this determination, by comparison of the measured values of the registration correction patch read in Step 202 with the thresholds computed from the values read in Step 200, determination is made as to whether the registration correction patch is within the range of the threshold values or not. That is, if the measured value of the length of the registration correction patch is within the range of respective threshold values $tk\times(1\pm\alpha k)$, $ty\times(1\pm\alpha y)$, $tm\times(1\pm\alpha m)$, and $tc\times(1\pm\alpha c)$, that are the design values of the lengths for each of the respective colors tk, ty, tm, and tc multiplied by the predetermined coefficients, then it is determined that the registration correction patch is normal, and if outside of the range, then it is determined to be noise of dirt or scratches or the like on the transfer roll 24.

In FIG. 6A is a diagram showing an example of undertaking the above determination as to whether the measured value of the length of the registration correction patches are within the threshold value ranges for the design values or not, in the case when the measured value Tm, the length of the registration correction patch for the M color, is within the threshold range $Tm1<Tm<Tm2$ (where $Tm1=tm\times(1-\alpha m)$, and $Tm2=tm\times(1+\alpha m)$).

Further, in FIG. 6B, measured value Ty, of the length of the registration correction patch for the Y color, is within the threshold range $Ty1<Ty<Ty2$ (where $Ty1=ty\times(1-\alpha y)$, and $Ty2=ty\times(1+\alpha y)$), and measured value Tm, of the length of the registration correction patch for the M color, is within the threshold range $Tm1<Tm<Tm2$ (where $Tm1=tm\times(1-\alpha m)$, and $Tm2=tm\times(1+\alpha m)$), but the length of the portion detected between the Y and the M color is shorter than the minimum value threshold of the Y color Ty1, and shorter than the minimum value threshold of the M color Tm1, so determination is not made that this portion is a normal registration correction patch of Y color or M color, and it is determined to be noise.

Next, when it is determined in Step 204 that the measured value of the registration correction patch length in question is within the threshold value range, in the next Step 206, the length of the registration correction patch that precedes the registration correction patch in question by one place is measured. In Step 208, comparison is made of the measured value of the length of the registration correction patch in question to the measured value of the length of the registration correction patch that precedes the registration correction patch in question by one place.

That is, this type of determination is made because if noise that is the same length as a registration correction patch is formed adjacent to a registration correction patch, then it cannot be determined whether the detected registration correction patch is noise or an ordinary registration correction patch. In this determination, if the detected registration correction patch is the same length as the one previous registration correction patch then it is determined that one of the two patches is noise, but since it is not clear which of the patches is noise, in Step 210 the pair of registration correction patches with the same length are stored as noise. However, if the lengths are different, then no determination as noise is made, and the routine proceeds to Step 212, and when normal-error determination has been completed for all of the registration correction patch data, the routine proceeds to Step 114 of FIG. 4. When determination is not complete then the routine returns again to Step 202, and the above processing is repeated until normal-error determination has been completed for all of the registration correction patch data.

In Step 204, if the measured value of the length of the registration correction patch is not within the threshold range then the routine proceeds to Step 210, and the registration correction patch is stored as noise.

Next, in Step 114 of FIG. 4, if there is a registration correction patch present that is stored as noise in Step 210 of FIG. 5, then the routine proceeds to Step 116 of FIG. 4, and if there is none present then the routine proceeds to Step 118.

In Step 116, registration correction is carried out for each of the respective colors only for the normal registration correction patches, with the registration correction patch(es) stored as noise excluded. That is, as shown in FIG. 7, the noise portion between the Y color and the M color is excluded, and the remaining registration correction patches are used for carrying out registration correction. Tl1 is the distance from detecting the K color registration correction patch to detecting the Y color registration correction patch, T12 is the distance from detecting the registration correction patch of the K color to detecting the registration correction patch of the M color, and T13 represents the distance from detecting the registration correction patch of the K color to detecting the registration correction patch of the C color. The amount of registration misalignment is computed from the differences of the related measured values of the above distances and the theoretical values of these distances, and registration correction is carried out. Tl1, Tl2, and Tl3 can be derived from the measured times using the reference position as a reference.

When there is no noise present in the registration correction patches then, in Step 118, registration correction is executed using the measured values of all of the registration correction patches.

Here, FIG. 8 is a diagram illustrating a registration correction method with plural groups of combinations of K, Y, M, and C color registration correction patches. The first and third group of K, Y, M, and C color registration correction patches, counting from the reference patch, are normal, but in the second group of K, Y, M, and C color registration correction patches, the measured value Ty of the length of the Y color registration correction patch is outside of the threshold range, and therefore it is determined that a range is noise, and when carrying out registration correction, registration correction is made using the average of the measured values of plural values excluding the measured value Tl1_2, such that: Tl1=(Tl1_1+Tl1_3)÷2; Tl2=(Tl2_1+Tl2_2+Tl2_3)÷3; and Tl3=(Tl3_1+Tl3_2+Tl3_3)÷3.

Second Exemplary Embodiment

In the first exemplary embodiment when carrying out registration correction, determination was made of whether a registration correction patch was normal or not using the length of the registration correction patch, but in the second exemplary embodiment determination is made of whether a registration correction patch was normal or not using the density of the registration correction patch.

Since the configuration of the image forming apparatus according to the second exemplary embodiment is similar to the above configuration of the image forming apparatus 10 according to the first exemplary embodiment (see FIG. 1), explanation will be omitted.

In FIG. 3B is shown a table of design values and predetermined coefficients for design values of the densities of registration correction patches of each of the colors K, Y, M and C. These design values and predetermined coefficients for design values are stored in advance in the memory unit 62, and the design values and predetermined coefficients for design values are read from the memory unit 62.

In FIG. 9 is a flow chart showing processing for carrying out registration correction using registration correction patches, with different densities and different colors in the patch array direction, for correcting registration correction patch alignment used in an image forming apparatus according to the present exemplary embodiment. Steps in FIG. 9 that undertake the same processing as those in FIG. 4 are allocated the same numerals as in FIG. 4, and a simple explanation of processing will be given.

First, in Step 300, as in the first exemplary embodiment, registration correction patches are formed on the transfer roll 24 such that they are different in density and color to the adjacent patches in the patch array direction. Next, in Step 102, the surface peripheral velocity of the transfer roll 24 is read out from the ROM 80 and stored in the RAM 78. In the next Step 302, times of passing of the leading edges and the trailing edges of the patches for each of the colors formed on the transfer roll 24 past the irradiation position of the light irradiated from the optical sensor 28 are measured, based on the change in the amount of reflected light detected by the optical sensor 28, and these times and the optical density of the registration correction patches are stored in the RAM 78. In the next Step 106, for the registration correction patches for each of the colors, the positions from a reference position of the leading edges are computed and positions from a reference position of the trailing edges are computed, based on: the surface peripheral velocity of the transfer roll 24; the times of passing of the leading edges and trailing edges of the registration correction patches past the irradiation position; and a reference position of a reference patch. The computed leading edge positions and trailing edge positions are stored in the RAM 78. In the next Step 110, if detection of all of the registration correction patches formed on the transfer roll 24 has been made, then the routine proceeds to Step 304, and if detection of all of the registration correction patches is not complete then the routine returns to Step 302, and processing is repeated until all of the registration correction patches have been detected.

In Step 304, processing is carried out for determining whether the detected registration correction patches are normal registration correction patches or not. A routine for this determination of whether the registration correction patches are normal is shown in the flow chart of FIG. 10.

First, in Step 400, the design values and predetermined coefficients of the registration correction patches are read. After reading these values, in Step 402, the measured densities of the registration correction patches for each of the colors, stored in the RAM 78 at Step 302 of FIG. 9, are read.

In the next Step 404, determination is carried out as to whether a patch is a normal patch or not, by carrying out determination as to whether the measured values of the densities of the registration correction patches are within threshold ranges, described later, or not, the threshold ranges being derived from the registration correction patch design values and predetermined coefficients. In this determination, comparison is made of the measured values of the registration correction patches read in Step 402 with the thresholds computed from the values read in Step 400. That is, if the measured value of the density of the registration correction patch is within the range of respective threshold values $dk\times(1\pm\beta k)$, $dy\times(1\pm\beta y)$, $dm\times(1\pm\beta m)$, and $dc\times(1\pm\beta c)$, that are the design values of the densities for each of the respective colors dk, dy, dm, and dc multiplied by the predetermined coefficients, then it is determined that it is a normal registration correction patch, and if outside of the range, then it is determined to be noise of dirt or scratches or the like on the transfer roll 24.

FIG. 11A is a diagram showing an example of undertaking the above determination as to whether the measured value of the density of the registration correction patches are within the threshold value ranges for the design values or not, in the case when the measured value Dk, the density of the registration correction patch for the K color, is within the threshold range ($Dk1=dk\times(1-\beta k)$, and $Dk2=dk\times(1+\beta k)$).

Further, in FIG. 11B, measured value Dy, of the density of the registration correction patch for the Y color, is within the threshold range $Dy1<Dy<Dy2$ (where $Dy1=dy\times(1-\beta y)$, and $Dy2=dy\times(1+\beta y)$), and measured value Dm, of the density of the registration correction patch for the M color, is within the threshold range $Dm1<Dm<Dm2$ (where $Dm1=dm\times(1-\beta m)$, and $Dm2=dm\times(1+\beta m)$), but the density of the portion detected between the Y and the M color is lower than the minimum value threshold of the Y color Dy1, and lower than the minimum value threshold of the M color Dm1, so determination is not made that this portion is a normal registration correction patch of Y color or M color, and it is determined to be noise.

In the next Step 404, if the measured value of the density of the registration correction patch, when within the threshold range then in the next Step 406, the density of the registration correct patch one previous to the registration correction patch in question is measured. In Step 408, the measured value of the density of the registration correction patch in question is compared to the measured density of the registration correction patch one previous to the registration correction patch in question.

This type of determination is made because if noise that is the same density as a registration correction patch is formed adjacent to a registration correction patch, then it cannot be determined whether the detected registration correction patch is noise or an ordinary registration correction patch. In this determination, if the detected registration correction patch is the same density as the density of the one previous registration correction patch then it is determined that one of the two patches is noise, but since it is not clear which of the patches is noise, in the next Step 410 the pair of registration correction patches with the same density are stored as noise. However, if the densities are different, then no determination as noise is made, and the routine proceeds to the next Step 412, and when normal-error determination has been completed for all of the registration correction patch data, the routine proceeds to Step 114 of FIG. 9. When determination is not complete then the routine returns again to Step 402, and the above processing is repeated until normal-error determination has been completed for all of the registration correction patch data.

In Step 404, when the measured value of the density of the registration correction patch is not within the threshold range, then the routine proceeds to Step 410, and the registration correction patch is stored as noise.

Next, in Step 114 of FIG. 9, if there is a registration correction patch present that has been determined in Step 410 of FIG. 10 to be noise, then the routine proceeds to Step 116, and if there is none present then the routine proceeds to Step 118.

In Step 116, registration correction is carried out for each of the respective colors only for the normal registration correction patches, with the registration correction patch(es) stored as noise excluded. That is, as shown in FIG. 7, the noise portion between the Y color and the M color is excluded, and the remaining registration correction patches are used for carrying out registration correction. The amount of registration misalignment is computed from the differences of the measured values of the distances of the registration correction patches of the respective colors from the registration correction patch of the K color T11, T12, and T13 and the theoretical values of these distances, and registration correction is carried out.

When there is no noise present in the registration correction patches then, in Step 118 of FIG. 9, registration correction is executed using the measured values of all of the registration correction patches.

FIG. 12 is a diagram illustrating a registration correction method with plural groups of combinations of K, Y, M, and C color registration correction patches. The first and third groups of K, Y, M, and C color registration correction patches, counting from the reference patch, are normal, but in the second group of K, Y, M, and C color registration correction patches, the measured value of the density of the portion between the K color and the Y color is within the Y color registration correction patch threshold range. Therefore, it is not possible to determine which of this portion or the adjacent registration correction patch for Y color is noise or not. So when registration correction is carried out, this portion and the adjacent registration correction patch for Y color are excluded and registration correction is made using the average of the measured values of plural values excluding the measured values Tl1_2, such that: $Tl1=(Tl1_1+Tl1_3)\div 2$; $Tl2=(Tl2_1+Tl2_2+Tl2_3)\div 3$; and $Tl3=(Tl3_1+Tl3_2+Tl3_3)\div 3$.

In the present embodiment registration correction patches are formed using the colors of Black (K), Yellow (Y), Magenta (M) and Cyan (C), and registration correction is carried out, but in the present invention registration correction patches may be formed such that all of the lengths thereof, or the densities thereof, are different from each other, or may be formed such that the lengths of adjacent patches, or their densities, are different from each other. For example, in an arrangement of registration correction patches such as that shown in FIG. 8, even if the lengths or densities of the K color and M color, or Y color and C color, registration correction patches are the same as each other, the lengths of the adjacent registration correction patches K color and Y color, Y color and M color, M color and C color, C color and K color may be made to be different from each other. By doing so, only two design values for the lengths, or densities, need be set in the memory unit 62, and processing load is reduced when carrying out determination as to whether a measured value is within the threshold range or not.

According to the first exemplary embodiment and the second exemplary embodiment, when carrying out registration correction, discrimination with good precision may be carried out between patches and noise, even when there is noise included in, or in between, patches. By carrying out registration correction with noise portions removed, there is the effect that the necessity to form patches again disappears, and increases in the time for registration, and wasteful toner use, may be avoided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image holding members, on respective surfaces of which toner images are formed, the toner images being arrayable such that the length in the array direction and the color are different between adjacent toner images from each other;

a transfer body, onto which the toner images formed on the plurality of image holding members are transferred, such that there is a spacing between the adjacent toner images in the array direction and the length and the color of the adjacent toner images are different from each other;

a detecting unit, detecting the length in the array direction of each of the toner images transferred onto the transfer body and detecting the amount of shift in the array direction of each toner image from a reference position; and a correction unit, correcting misalignment of each toner image of each color using the shift amount of the toner image with a length detected by the detecting unit within a predetermined threshold range.

2. The image forming apparatus of claim 1, wherein for the respective colors a plurality of toner images are transferred onto the transfer body, and for correcting the misalignment of each of the toner images of the respective colors an average value of shift amount of each toner image for each color is used, the average value of shift amount being obtained using the shift amount of the toner image with a length detected by the detecting unit within a predetermined threshold range.

3. The image forming apparatus of claim 2, wherein the transfer body is a transfer roll that transfers a toner image that has been transferred onto an intermediate transfer body onto a recording medium.

4. The image forming apparatus of claim 2, wherein when the length detected by the detecting unit of one of the toner images is substantially the same as that of an adjacent toner image, then correcting the misalignment of the toner images of the respective colors is carried out excluding the shift amounts of the pair of toner images with substantially the same length.

5. The image forming apparatus of claim 4, wherein the transfer body is a transfer roll that transfers a toner image that has been transferred onto an intermediate transfer body onto a recording medium.

6. The image forming apparatus of claim 1, wherein the transfer body is a transfer roll that transfers a toner image that has been transferred onto an intermediate transfer body onto a recording medium.

7. An image forming apparatus comprising:

a plurality of image holding members, on respective surfaces of which toner images are formed, the toner images being arrayable such that the density and the color are different between adjacent toner images in the array direction from each other;

a transfer body, onto which the toner images formed on the plurality of image holding members are transferred, such that there is a spacing between the adjacent toner images in the array direction and the density and the color of the adjacent toner images are different from each other;

a detecting unit, detecting the density of each of the toner images transferred onto the transfer body and detecting the amount of shift in the array direction of the toner image from a reference position; and a correction unit, correcting misalignment of each toner image of each color using the shift amount of the toner image with a density detected by the detecting unit within a predetermined threshold range.

8. The image forming apparatus of claim 7, wherein for the respective colors a plurality of toner images are transferred onto the transfer body, and for correcting the misalignment of each of the toner images of the respective colors an average value of shift amount of each toner image for each color is used, the average value of shift amount being obtained using the shift amount of the toner image with a density detected by the detecting unit within a predetermined threshold range.

9. The image forming apparatus of claim 8, wherein the transfer body is a transfer roll that transfers a toner image that has been transferred onto an intermediate transfer body onto a recording medium.

10. The image forming apparatus of claim 7, wherein when the density detected by the detecting unit of one of the toner images is substantially the same as that of an adjacent toner image, then correcting the misalignment of the toner images of the respective colors is carried out excluding the shift amounts of the pair of toner images with substantially the same density.

11. The image forming apparatus of claim 10, wherein the transfer body is a transfer roll that transfers a toner image that has been transferred onto an intermediate transfer body onto a recording medium.

12. The image forming apparatus of claim 7, wherein the transfer body is a transfer roll that transfers a toner image that has been transferred onto an intermediate transfer body onto a recording medium.

* * * * *